United States Patent [19]

De Bijl et al.

[11] Patent Number: 4,949,016

[45] Date of Patent: Aug. 14, 1990

[54] CIRCUIT FOR SUPPLYING CONSTANT POWER TO A GAS DISCHARGE LAMP

[75] Inventors: Adrianus M. J. De Bijl; Johannes M. Van Meurs, both of Eindhoven, Netherlands

[73] Assignee: U.S. Philips Corporation, New York, N.Y.

[21] Appl. No.: 285,181

[22] Filed: Dec. 15, 1988

[30] Foreign Application Priority Data

Jan. 6, 1988 [NL] Netherlands ..... 8800015

[51] Int. Cl.[5] ..... H05B 37/02; H05B 39/04; H05B 41/14

[52] U.S. Cl. ..... 315/208; 315/224; 315/226; 315/241 R; 315/DIG. 7; 315/DIG. 4; 315/DIG. 5; 363/97

[58] Field of Search ..... 315/208, 224, 226, 241 R, 315/246, DIG. 7, DIG. 5, DIG. 4; 363/97, 106, 109, 131

[56] References Cited

U.S. PATENT DOCUMENTS

| | | | |
|---|---|---|---|
| 4,170,747 | 10/1979 | Holmes | 315/208 |
| 4,412,154 | 10/1983 | Klein | 315/208 |
| 4,471,269 | 9/1984 | Ganser et al. | 315/208 |
| 4,511,823 | 4/1985 | Eaton et al. | 315/208 |
| 4,525,650 | 6/1985 | Hicks et al. | 315/226 |
| 4,553,070 | 11/1985 | Sairanen et al. | 315/DIG. 7 |
| 4,585,974 | 4/1986 | Stupp et al. | 315/224 |
| 4,587,461 | 5/1986 | Hanlet | 315/224 |
| 4,700,113 | 10/1987 | Stupp et al. | 315/208 |
| 4,766,350 | 8/1988 | Hüsgen et al. | 315/224 |
| 4,791,338 | 12/1988 | Dean et al. | 315/278 |
| 4,812,736 | 3/1989 | Albach et al. | 315/DIG. 7 |

FOREIGN PATENT DOCUMENTS 2016222 9/1979 United Kingdom .

*Primary Examiner*—Eugene R. LaRoche
*Assistant Examiner*—Michael B. Shingleton
*Attorney, Agent, or Firm*—Bernard Franzblau

[57] ABSTRACT

An electric arrangement for igniting and supplying a gas discharge lamp (1). The arrangement is connected to an alternating voltage source and comprises a rectifier bridge (7) connected to a DC/DC converter provided with a rectifier element (11), a coil (10) and a high-frequency switched semiconductor switching element (12) coupled to a drive circuit. The DC/DC converter is connected to the input terminals (16, 17) of a high-frequency DC/AC converter incorporating the lamp and provided with semiconductor switching elements (21,24). A capacitor (15) is arranged between the input terminals of the DC/AC converter and a sensor (22) for measuring the converter current is arranged between one of the input terminals (17) and a semiconductor switching element (21) of the DC/AC converter. The lamp is connected in series with a frequency-dependent impedance 20. A drive circuit (13) of the semiconductor switching element in the DC/DC converter is coupled to a control circuit (14) and is also coupled to the capacitor (15). The voltage across the capacitor (15) is set to a desired value by adjusting the frequency and the period of conductance of the semiconductor switching element (12). The sensor (22) is coupled to a second control circuit (27) which is connected to the drive circuits (**21*a*, 24*a*) of the semiconductor switching elements (21, 24**) of the DC/AC converter whereby the frequency and/or period of conductance of the switching elements of the DC/AC converter, and hence the power consumption of the lamp, can be regulated.

15 Claims, 1 Drawing Sheet

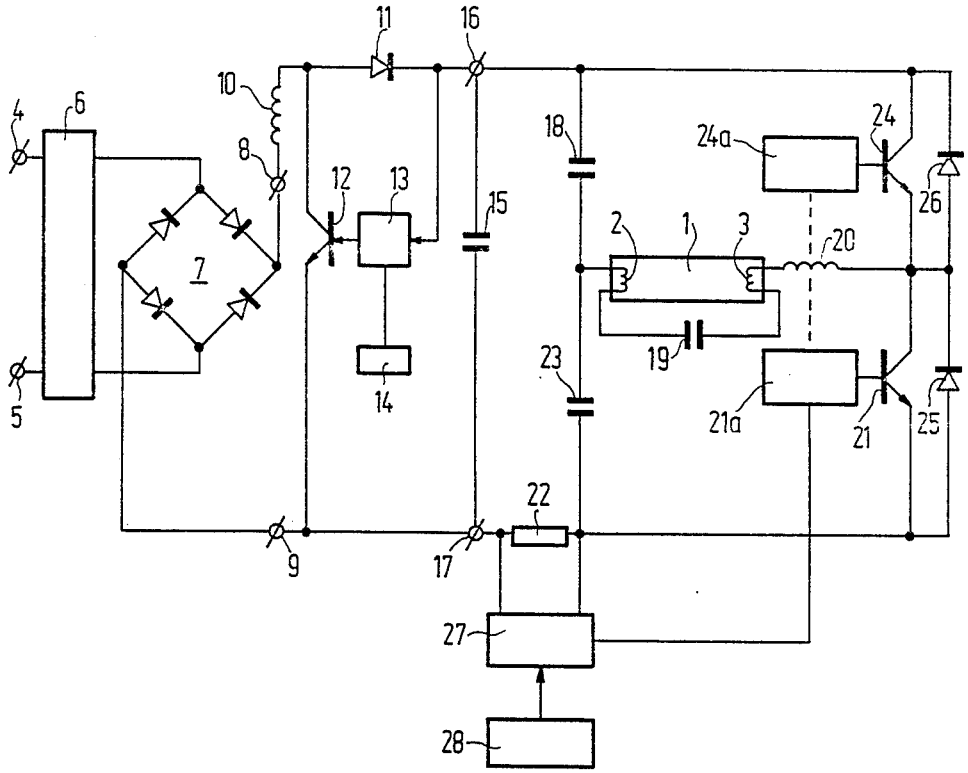
11
16
10
4
6
8
12
13
18
24a
24
26
15
2
1
3
20
7
19
23
14
5
21a
21
25
22
9
17
27
28

CIRCUIT FOR SUPPLYING CONSTANT POWER TO A GAS DISCHARGE LAMP

BACKGROUND OF THE INVENTION

This invention relates to an electric arrangement for igniting and supplying a gas discharge lamp, which arrangement is intended to be connected to an alternating voltage source and comprises a rectifier bridge connected to a DC/DC converter provided with a rectifier element, a coil and a high-frequency switched semiconductor switching element coupled to a drive circuit, said DC/DC converter being connected to the input terminals of a high-frequency DC/AC converter incorporating the lamp and provided with semiconductor switching elements. A capacitor is arranged between said input terminals, and a sensor for measuring the current taken off by the converter is connected between one of the input terminals and a semiconductor switching element of the DC/AC converter.

An arrangement of this type is described in British Patent Application 2,016,222 A laid open to public inspection.

This Patent Application describes a power supply circuit including a DC/DC converter, e.g. a forward converter, which is coupled to a high-frequency DC/AC converter. The DC/DC converter operates as a current source for the high-frequency switching DC/AC converter coupled thereto. A square-wave current is applied to the lamp by means of the latter converter. The circuit also includes a sensor with which the current intensity of the lamp is measured and compared with a fixed reference current by means of a control circuit coupled to the sensor. The control circuit ensures, in conjunction with a drive circuit which is coupled thereto, and which serves to control the semiconductor switching element in the forward converter, that the said switching element is rendered conducting and non-conducting in such a way that the current intensity supplied to the lamp is set to a predetermined value.

However, a drawback of the known circuit is that the power consumption of the lamp, and hence the light output, decrease when operating the lamp at a relatively low lamp voltage (for example, due to ageing or, in the case of a low-pressure mercury vapour discharge lamp, operation in a relatively hot location). Even when placing in the circuit a low-pressure mercury vapour discharge lamp with a rare gas mixture present in the lamp vessel in a composition which deviates from the conventional composition and results in a like deviation of the operating voltage, it has been found that the light output of such a lamp decreases to an unacceptably low level.

SUMMARY OF THE INVENTION

It is an object of the invention to overcome the above-mentioned problem by providing an arrangement with which the power consumption of the lamp during operation is always substantially constant.

According to the invention, an arrangement for igniting and supplying a discharge lamp of the type described in the opening paragraph is therefore characterized in that the lamp is arranged in series with a frequency-dependent impedance, in that the drive circuit of the semiconductor switching element in the DC/DC converter is coupled to a control circuit and is also coupled to the capacitor, so that the voltage across the capacitor is set to a certain value by adjusting the frequency and the period of conductance of the semiconductor switching element, and in that the sensor is coupled to a second control circuit which is connected to the drive circuits of the semiconductor switching elements of the DC/AC converter and which control or adjust the frequency and/or period of conductance duty cycle of the switching elements of the DC/AC converter, whereby the power consumption of the lamp can be adjusted.

In the arrangement according to the invention during operation a constant direct voltage is realized across the capacitor arranged between the DC/AC converter input terminals by a suitable choice of the period of conductance and the frequency of the semiconductor switching element in the DC/DC converter (such as an up-converter). By a suitable choice of the frequency and the periods of conductance of the semiconductor switching elements in the DC/AC converter, the capacitor current which is taken off is maintained substantially constant by means of the sensor and the control circuit connected thereto. The capacitor receives its energy via the DC/DC converter from the power supply mains. The power taken off the capacitor, and hence the power consumption of the lamp, is then also constant because the impedance of the element arranged in series with the lamp can be varied by controlling the frequency. The losses in the switching elements, the coil in series with the lamp and the sensor are then as small as possible.

The light output of a lamp incorporated in the arrangement according to the invention is favourable. Even in the case of a lamp voltage decrease occurring during the lifetime of the lamp the light output is stabilized at a constant level.

The invention is particularly advantageous for use in low-pressure mercury vapour discharge lamps in which the operating voltage is modified due to temperature variations in the discharge tube. During operation of compact flur lamps whose discharge tube is surrounded by an outer envelope, a decrease of the operating voltage easily occurs due to an increase of the temperature in the ambiance of the discharge tube. The arrangement is therefore very suitable to be incorporated in such a compact fluorescent lamp. The arrangement according to the invention makes it possible to maintain the lamp power consumption constant over a broad temperature range.

The arrangement according to the invention provides the possibility of setting different types of lamps to the same power.

In a preferred embodiment of the arrangement according to the invention, the switching frequency of the semiconductor switching element in the DC/DC converter and the frequency of the switching elements in the DC/AC converter are equal to each other or are a multiple of each other.

The electric currents flowing through the capacitor during operation, which capacitor is arranged between the input terminals of the DC/AC converter, then compensate each other completely or partly. The load of the capacitor is then relatively low, which favourably influences the lifetime of this element.

In a special embodiment of the arrangement according to the invention, the voltage across the capacitor is continuously adjustable by setting the frequency and the period of conductance of the semiconductor switching element in the DC/DC converter so that the lamp power consumption is adjustable. By using, for example, a flyback converter as a DC/DC converter, a user can adjust a given voltage across the capacitor so that the lamp can be dimmed. However, the current taken off the capacitor remains invariably constant. The DC voltage across the capacitor is proportional to the power consumption of the dimmed lamp. Dimming of the lamp by means of the switching element in the DC/DC converter has the advantage that power losses in the switching elements and the coil in the DC/AC converter are relatively low during dimming.

BRIEF DESCRIPTION OF THE DRAWING

The invention will now be described in greater detail, by way of example, with reference to the accompanying drawing diagrammatically showing an embodiment of the arrangement according to the invention.

DESCRIPTION OF THE PREFERRED EMBODIMENTS

In the drawing the reference numeral 1 denotes a tubular low-pressure mercury vapour discharge lamp. The lamp has two preheatable electrodes 2 and 3. The lamp is incorporated in an electric arrangement which can be connected to an alternating voltage source (for example, 220 V, AC) by means of the input terminals 4 and 5. The terminals are connected to a rectifier bridge 7 via input filter 6 and this bridge has its output connected to the input terminals 8 and 9 of a DC/DC converter in the form of an up-converter. Terminal 8 is connected to a series arrangement of a coil 10 and a rectifier element (diode) 11. The junction point of 10 and 11 is connected to the collector of a semiconductor switching element 12 whose emitter is connected to the terminal 9. In this description the semiconductor switching elements are in the exemplary form of transistors. In a practical embodiment the said elements are MOS-FETs. The base of transistor 12 is connected to a drive circuit 13 by means of which the switching element 12 can be rendered high-frequency conducting and non-conducting. The drive circuit 13 is coupled to a control circuit 14 with a reference voltage by means of which the period and the frequency of conductance and non-conductance of switching element 12 are influenced in such a way that a direct voltage with a stabilized value is adjusted across capacitor 15 which is arranged between the terminals 16 and 17. The terminals 16 and 17 are the input terminals of a DC/AC converter incorporating the lamp 1. The terminals 16 and 17 are interconnected by means of a series arrangement of a capacitor 18, a load circuit comprising the lamp 1 (with a capacitor 19 arranged in parallel across the electrodes 2 and 3) and a frequency-dependent impedance 20 (for example, a coil) arranged in series with the lamp. Also arranged in series with 18, 1 and 20 is a first semiconductor switching element 21 and a sensor 22 (for measuring the current taken off the capacitor by the DC/AC converter see the description hereinafter). A capacitor 23, which is also connected to the junction point of capacitor 18 and the lamp 1, is connected to the junction point of sensor 22 (for example, a resistor having a low resistance value, a Hall element or another DC current sensor) and switching element 21. The circuit comprising capacitor 18, the lamp 1 (with capacitor 19) and the coil 20 is shunted by the second semiconductor switching element 24.

The two switching elements 21 and 24 are alternately rendered high-frequency conducting and non-conducting by means of the drive circuits **21*a* and 24*a*, respectively, which are shown diagrammatically only. The drive circuits 21*a* and 24*a* are coupled together (for example, via a transformer and are formed as described in Netherlands Patent Application 8400923 laid open to public inspection). This coupling is shown diagrammatically by means of a broken line in the drawing. The two semiconductor switching elements 21 and 24 are shunted by anti-parallel connect freewheel diodes 25 and 26** (these are integrated in a MOS-FET).

The sensor 22 is coupled to a control circuit 27 for comparing the voltage measured across the sensor 22 (and hence the current taken off by the converter) with a reference voltage which is generated in circuit 28.

The control circuit 27 is coupled to the two drive circuits **21*a* and 24*a* thereby to control not only the switching frequency of the two semiconductor switching elements 21 and 24 is controlled but also the time per period during which the elements are conducting. One such period is the period when a switching element is conducting once and is non-conducting once ("duty cycle"). The current taken off the capacitor 15 and hence the power consumption of the lamp 1 is maintained constant by means of the control circuit 27**.

The converter also includes a starter circuit for starting the high-frequency switching of the converter (not shown in the drawing). Such a circuit is described in the previously mentioned Netherlands Patent Application 8400923.

The arrangement shown in the drawing operates as follows. After connecting the terminals 4 and 5 to the power supply mains, a constant voltage across the capacitor 15 is realized by choosing the frequency of non-conductance/conductance and the duty cycle of the semiconductor switching element 12. The elements 10, 11 and 12 constitute a so-called up-converter. The voltage across the capacitor 15 is higher than the peak value of the voltage between the terminals 8 and 9.

Via a starter circuit (not shown) the DC/AC converter is started and the switching elements 21 and 24 are rendered alternately high-frequency conducting and non-conducting. The power for the lamp 1 is taken off capacitor 15. The power taken off this capacitor is now maintained constant by means of sensor element 22. The voltage measured across this element is compared by the control circuit 27 with a reference voltage from the reference voltage circuit 28. If, for example, the voltage across the lamp decreases, the lamp current must increase in order to maintain the lamp power consumption constant. This is realized by decreasing the switching frequency of transistors 21 and 24. The impedance of inductor 20 decreases and that of capacitor 19 increases, which results in an increase of the lamp current. The lamp power consumption then remains constant.

In a practical embodiment the frequency of the DC/AC converter is approximately 28 kHz. The frequency of the DC/DC converter is 56 kHz. By forming the DC/DC converter as a flyback converter, the direct voltage across the capacitor 15 can be adjusted and the power consumption of the lamp 1 can be influenced (dimming effect) by a modification of the frequency or the duty cycle of the switch 12.

If the duty cycle of the flyback converter is adjusted, and hence the voltage across capacitor 15 is given a certain lower value, the power consumption of the lamp is controlled. It has been found that the frequency of the DC/AC converter remains substantially constant. Only the voltage across the central branch (1, 19 and 20) of the DC/AC converter is proportionally lower with the voltage across capacitor 15. It is advantageous that the lamp can be dimmed without a large modification of the frequency. The risk of radio interference is smaller than in circuits in which the lamp is dimmed by modifying the frequency.

In this embodiment the lamp is a tubular low-pressure mercury vapour discharge lamp having a power of 32 W (TL-D h.f.). The capacitance of capacitor 15 is 47 μF, that of capacitor 19 is 10 nF. The capacitance of the capacitors 18 and 23 is 0.5 μF. The coil 10 has a value of approximately 2 mH, coil 20 has a value of approximately 3.2 mH. The sensor element 22 is a resistor of 0.1 Ω. The diode 11 is a BYV 26 C (Philips). The semiconductor switching elements 12, 21 and 24 are MOS-FETs of the type BUZ 76 (Philips). A Voltage of 220 V (AC), 50 Hz is present between the terminals 4 and 5.

What is claimed is:

1. An electric arrangement for igniting and supplying a gas discharge lamp from an alternating voltage source, said arrangement comprising: a rectifier bridge connected to said alternating voltage source and to a DC/DC converter provided with a rectifier element, a coil and a high-frequency switched semiconductor switching element coupled to a drive circuit, said DC/DC converter being connected to input terminals of a high-frequency DC/AC converter which includes the lamp and semiconductor switching elements, a capacitor coupled between said input terminals of the DC/AC converter, a sensor for measuring the converter current, said sensor being coupled between one of the input terminals and a semiconductor switching element of the DC/AC converter, wherein the lamp is connected in series with a frequency-dependent impedance and the drive circuit of the semiconductor switching element in the DC/DC converter is coupled to a control circuit and to the capacitor, the voltage across the capacitor being set to a certain value by adjusting at least one of the frequency and the period of conductance of the semiconductor switching element in the DC/DC converter, and means coupling the sensor to a second control circuit connected to drive circuits of the semiconductor switching elements of the DC/AC converter whereby the frequency and/or period of conductance of the switching elements of the DC/AC converter, and hence the power consumption of the lamp, can be controlled.

2. An electric arrangement as claimed in claim 1, wherein the switching frequency of the semiconductor switching element in the DC/DC converter and the frequency of the switching elements in the DC/AC converter are equal to each other or are a multiple of each other.

3. An electric arrangement as claimed in claim 2, wherein the voltage across the capacitor is continuously adjustable by adjusting the frequency and the period of conductance of the semiconductor switching element in the DC/DC converter.

4. An electric arrangement as claimed in claim 1, wherein the voltage across the capacitor is continuously adjustable by changing the frequency and the period of conductance of the semiconductor switching element in the DC/DC converter.

5. Apparatus for operating an electric discharge lamp comprising:

a DC/DC converter having input terminals coupled to a source of rectified AC voltage, said converter including a rectifier element, an inductor and a first semiconductor switching element connected across said input terminals and with a control electrode of the first switching element coupled to a drive circuit, a first capacitor connected across an output of the DC/DC converter, a first control circuit coupled to said drive circuit to adjust the first capacitor voltage by adjusting at least one of the frequency and duty cycle of the first semiconductor switching element, a high-frequency DC/AC converter having input terminals coupled to the output of the DC/DC converter, said DC/AC converter comprising;

second and third capacitors connected in a first series circuit across said input terminals of the DC/AC converter and second and third semiconductor switching elements connected in a second series circuit across said input terminals of the DC/AC converter, means for coupling a frequency-dependent impedance element in series with said discharge lamp between a first junction point of the second and third capacitors and a second junction point of said second and third semiconductor switching elements, means for deriving a control voltage determined by the DC/AC converter current, drive circuit means coupled to control electrodes of the second and third semiconductor switching elements, and a second control circuit having an input coupled to said control voltage deriving means and an output coupled to said drive circuit means thereby to control the switching frequency and/or duty cycle of the second and third semiconductor switching elements and thus the lamp power.

6. Apparatus as claimed in claim 5 wherein said discharge lamp is of the type having first and second preheatable electrodes, a fourth capacitor, and means for connecting said fourth capacitor in parallel with the discharge lamp such that the fourth capacitor provides a separate path for current flow through said preheatable electrodes.

7. Apparatus as claimed in claim 5 further comprising an adjustable source of reference voltage coupled to a second input of the second control circuit.

8. Apparatus as claimed in claim 5 further comprising first and second diodes connected in "anti-parallel" with said second and third semiconductor switching elements, respectively.

9. Apparatus as claimed in claim 5 wherein said first control circuit is operative to maintain a constant voltage across the first capacitor and said second control circuit is operative to maintain constant the current supplied by the first capacitor to the lamp via said DC/AC converter, whereby lamp power is maintained constant despite variations in lamp temperature.

10. Apparatus as claimed in claim 5 wherein said first and second control circuits operate said DC/DC converter and said DC/AC converter each at a high frequency, where said high frequencies are an integer multiple of each other.

11. Apparatus as claimed in claim 10 wherein the frequency of the DC/AC converter is approximately 28

KHz and the frequency of the DC/DC converter is 56 KHz.

12. Apparatus as claimed in claim 5 wherein the second control circuit has a second input coupled to a source of reference voltage which sets the level of lamp power, said second control circuit being responsive to said control voltage and to said reference voltage to adjust the switching frequency of the second and third semiconductor switching elements in a manner so as to maintain the lamp power constant at an adjustable level.

13. Apparatus as claimed in claim 5 wherein said drive circuit has an input coupled to the output of the DC/DC converter whereby the drive circuit is controlled by said first capacitor voltage and said first control circuit to control the first semiconductor switching element so as to maintain the first capacitor voltage constant.

14. Apparatus as claimed in claim 5 wherein said frequency dependent element comprises a second inductor, said apparatus further comprising a fourth capacitor coupled across the discharge lamp, said second control circuit being responsive to a change in said current determined control voltage to adjust the switching frequency of the second and third semiconductor switching elements and thus the frequency of current flowing through the second inductor and fourth capacitor in a sense to maintain the lamp power constant despite a change in lamp voltage.

15. Apparatus as claimed in claim 5 wherein said inductor and said first semiconductor switching element are connected in a first series circuit across the input terminals of the DC/DC converter, and the inductor, the rectifier element and the first capacitor are connected in a second series circuit across the input terminals of the DC/DC converter.

* * * * *